United States Patent [19]

Pommerening

[11] 4,072,317

[45] Feb. 7, 1978

[54] ROLLER SKATE HAVING ANKLE BRACING SUPPORT

[76] Inventor: Rudiger Pommerening, Glocksee 110, 3216 Salzhemmendorf, Germany

[21] Appl. No.: 687,433

[22] Filed: May 17, 1976

[30] Foreign Application Priority Data

May 17, 1975 Germany ..... 2522199

[51] Int. Cl.[2] ..... A63C 17/06; A63C 3/02

[52] U.S. Cl. ..... 280/11.23; 280/11.3; 280/11.36

[58] Field of Search ..... 280/11.36, 11.23, 11.19, 280/11.1 R, 11.13 T, 11.3, 11.22, 11.25

[56] References Cited

U.S. PATENT DOCUMENTS

| | | | |
|---|---|---|---|
| 578,081 | 3/1897 | Gibbs et al. | 280/11.3 |
| 922,774 | 5/1909 | Kennedy | 280/11.23 |
| 1,167,183 | 1/1916 | King | 280/11.36 |
| 1,456,881 | 5/1923 | Carley | 280/11.23 X |
| 1,529,967 | 3/1925 | Stanley et al. | 280/11.36 |
| 2,048,916 | 7/1936 | Bentzlin | 280/11.22 |
| 3,396,985 | 8/1968 | Kipnis | 280/11.26 |

FOREIGN PATENT DOCUMENTS

| | | | |
|---|---|---|---|
| 857,006 | 11/1952 | Germany | 280/11.36 |

*Primary Examiner*—Joseph F. Peters, Jr.
*Assistant Examiner*—Milton L. Smith
*Attorney, Agent, or Firm*—Allison C. Collard

[57] ABSTRACT

A roller skate of the type known as "single tracked" that is having only a single row of rollers one behind the other, is provided with fastenings for the foot of a wearer including an ankle bracing support extending above an ankle strap which holds the foot of a wearer in contact with a heel grip at the rear of a foot plate or base of the skate. The ankle bracing support includes a C-shape padded cradle for engaging part way around the leg of a wearer above the ankle and has a strap by which it can be securely fastened to the leg. The cradle itself is secured to the base or the heel grip in such a way that it can pivot about a transverse axis parallel to the axes of the rollers to permit free movement of the foot in the required direction but resists transverse or twisting movements to support the ankle against twisting.

13 Claims, 7 Drawing Figures

ROLLER SKATE HAVING ANKLE BRACING SUPPORT

BACKGROUND OF THE INVENTION

The present invention relates to roller skates, and particularly to roller skates having improved fastening means by which the skates can be fastened to the shoes of a user.

For satisfactory and successful use of roller skates it is vitally important that they may be readily fastened to different types of shoes, in particular to ordinary walking shoes such as are commonly worn by children and young adults. Moreover, the fastening of the roller skate must not interfere with the movement of the foot and ankle joints.

It is known that, if at all possible, the rolling action of roller skates should be as similar as possible to the sliding of ice skates. Single tracked roller skates (that is roller skates having two or more wheels one behind the other in tandem) have for that purpose already been developed; such are described, for example, in German patent Nos. 89 343, 223 485 and 857 006. However the fastening of such roller skates proved to be unsatisfactory because single tracked roller skates demand a tighter fit to the foot than conventional roller skates having four wheels or rollers which are conveniently referred to as "double tracked" roller skates since they have two pairs of side-by-side rollers defining two rolling tracks. Known fastenings for single tracked roller skates do not offer sufficient support for the ankles of a wearer and thus twisted ankles frequently occurred in their use. To try and counteract this, the rollers were provided with a wider contact surface, but this in turn lead to a worsening of the rolling action, making it similar to that of double tracked skates.

OBJECTS OF THE INVENTION

One object of the present invention is to provide a single tracked roller skate which has improved and quieter rolling action than either presently known single or double tracked roller skates.

Another object of the invention is to provide a single tracked roller skate which can be fastened to ordinary walking shoes securely and in a manner which ensures adequate support for the ankle of the wearer.

SUMMARY OF THE INVENTION

According to this invention, there is provided a single tracked roller skate of the type comprising a base mounted on a plurality of rollers and having first and second fastening means for fastening the skate to the foot of a wearer adjacent the toe and the ankle respectively, in which the second fastening means comprises a heel grip which projects upwardly from the rear of the base, and has an ankle strap to embrace the foot of a wearer about the ankle, and an ankle support engageable with the leg of a wearer above the ankle, the ankle support being pivotally displaceable with respect to the base about an axis substantially parallel to the rolling axis of the rollers.

Embodiments of the invention can thus be fastened to the foot in such a way that they provide adequate support to avoid twisting the ankle, even when only ordinary shoes are being worn or when the skates have rollers with only a narrow contact surface.

The ankle support is preferably mounted on the heel grip, and in one embodiment this is achieved by forming the ankle support with a cradle which partly surrounds the leg of a wearer (and is fixedly attached by means of a strap passing round the leg) which cradle has two arms pivotally connected to upstanding lugs one on each side of the heel grip. This pivotal attachment allows the ankle support cradle to pivot about an axis substantially parallel with the rolling axis of the rollers of the skate: this axis is also that about which the ankle of a wearer turns.

Alternatively the ankle support cradle may be connected to the heel grip by means of a two-part connection device which extends behind the back of the heel of a wearer. Such a connection device may comprise an articulated linkage or may comprise two or more telescopically engaged tubes which preferably have a rectangular profile.

A roller skate formed as an embodiment of this invention provides a secure and firm fastening to the foot and substantially eliminates the risk of twisting an ankle even when ordinary shoes are being worn. The heel grip acts as an abutment for the heel of the shoe and the ankle support is rigidly formed to resist or prevent turning movement with respect to the base of the skate about a longitudinal axis transverse the rolling axes of the rollers. The heel grip preferably has an associated ankle fastening strap which is attached to the heel grip and by means of which the foot can be pressed sufficiently firmly into engagement with the heel grip without hindering the foot joint in its movements. The ankle support prevents twisting of the ankle sideways but does not hinder the foot joint in its forward and backward pivoting movement about an axis parallel with the rolling axes of the rollers. The ankle support is preferably arranged to turn about an axis which is substantially coincident with that of a foot i.e. that defined by the ankle bone. Because of the good and firm support which embodiments of this invention offer it is possible to make use of narrower ball shaped rollers allowing in use a greater rolling inclination to each side without much difficulty. In addition the manufacture of the rollers in a resilient elastomeric material enhances the adhesion of the rollers to the road or other rolling surface, helps to reduce the noise during their use and absorbs shocks due to any unevenness of the surface.

Further features and advantages of this invention will become apparent from a consideration of the following description which is provided purely by way of non-restrictive example, and in which reference is made to the accompanying drawings.

DESCRIPTION OF THE PREFERRED EMBODIMENTS

Figure 2:
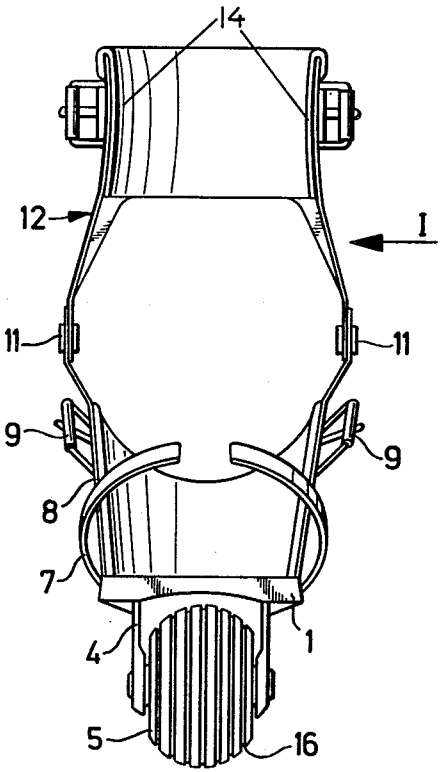
FIG. 2 is a front view of the embodiment of FIG. 1 as taken in the direction of the arrow II in FIG. 1.
Figure 1:
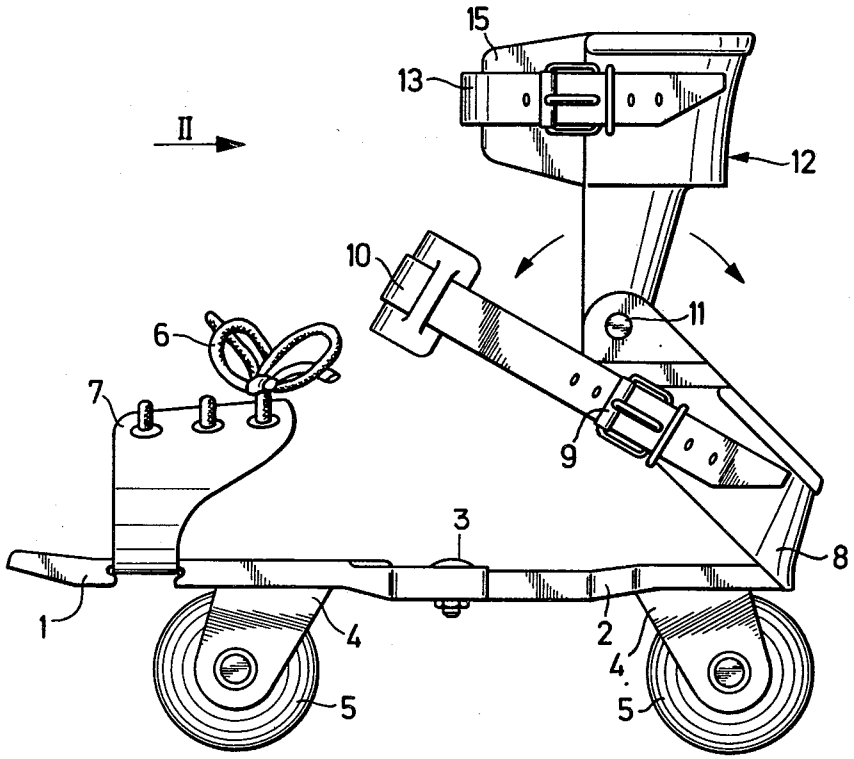
FIG. 1 is a side view of a roller skate formed as a first embodiment of the invention as taken in the direction of the arrow I in FIG. 2.

Referring now to the drawings, and particularly to FIGS. 1 and 2, there is shown a roller skate comprising a foot plate or base plate in two parts, a front part 1 and a rear part 2, the two parts 1, 2, being held together by means of a screw 3 which, in a known way passes through a hole in one part and a slot in the other to allow the skate to be adjusted in length to suit individual wearers. On the underside of the base plate parts 1, 2 are respective pairs of support arms 4 which carry respective rollers 5.

A broad strap 7, with laces 6, is fitted to the front of the base plate 1 and located in place in elongate recesses, to serve as a fastening for the toe part of the shoe of a wearer. The rear part 2 of the base plate incorporates a heel grip 8 which projects upwardly from the rear of the base plate part 2 and is provided with a strap 10 which is secured to the heel grip 8. The strap 10 has buckles 9 which permit adjustment in order to hold the foot of a wearer with the heel firmly pressed into the heel grip 8. The upper part of the heel grip 8 is pivotally connected by means of pivots 11 to a U-shape ankle support 12 which partly encircles the leg just above the ankle. The ankle support 12 is also provided with a fastening strap 13 and has on the inside some padding which is convexly curved in section (as indicated by the reference numeral 14 in FIG. 2) in order to prevent pressure or rubbing of the edges from chafing the leg of a wearer. The support 12 also has a padded tongue 15 which projects forwardly under the strap 13, in order to avoid bruising or discomfort to the shin bone when the strap 13 is firmly tightened.

The rolling surface of the rollers 5 is rounded, as can be seen in FIG. 2, and is provided with a plurality of circumferential grooves 16.

In the embodiments shown in the other drawings the components which are identical to corresponding components in the embodiment of FIGS. 1 and 2 have been indicated with the same reference numerals and will not be fully described in order to avoid unnecessary repetition.

Figure 3:
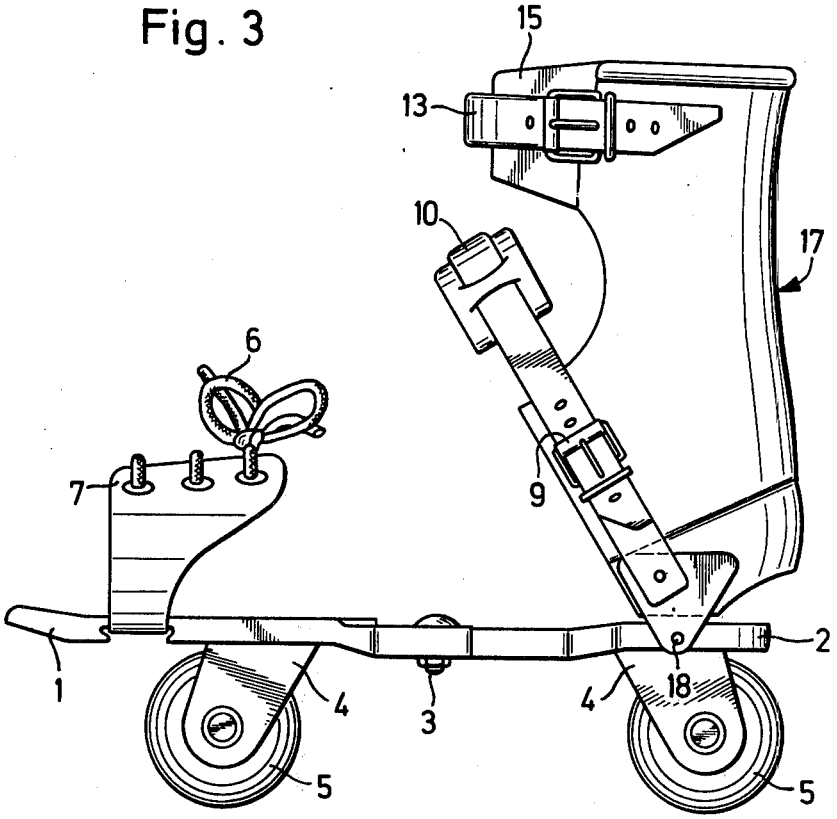
FIG. 3 is a side view of a roller skate formed as a second embodiment, having a one-piece heel grip covering the heel to a point above the ankle.
Figure 5:
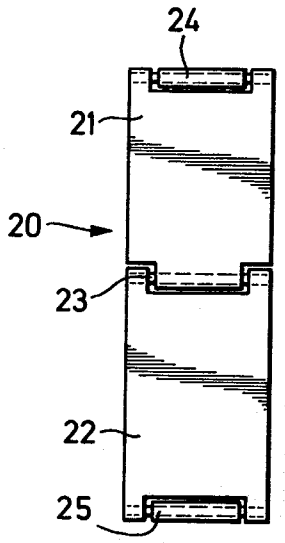
FIG. 5 is a plan view of the articulated linkage of the embodiment of FIG. 4 as taken in the direction of the arrow V in FIG. 4.

In FIG. 3 the heel grip comprises a resilient but rather stiff unitary heel piece which is connected directly to the rear base plate 2 by means of a triangular plate which is pivoted to the heel piece by a pivot (not labeled) and to the rear base plate 2 by a pivot 18. The heel strap 10 is also pivoted at the heel piece pivot so that the movement of the ankle joint is not impeded in any way.

Figure 4:
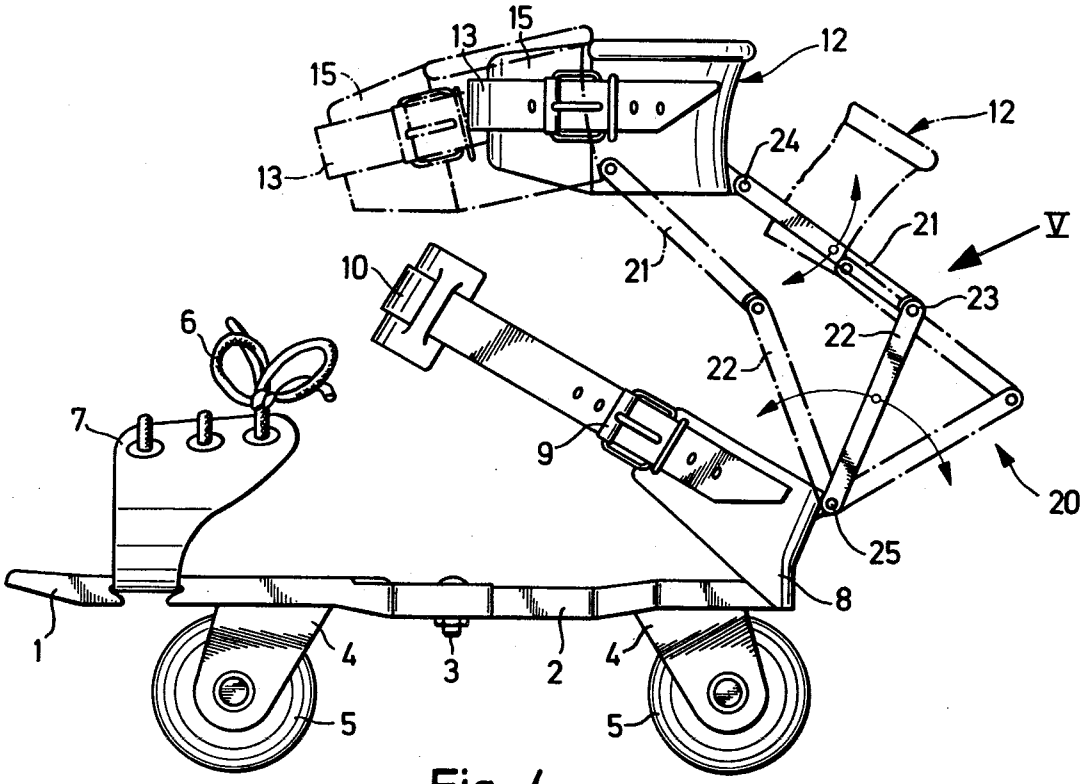
FIG. 4 is a side view of a roller skate formed as a third embodiment of the invention with an articulated linkage connecting the ankle support to the heel grip.
Figure 7:
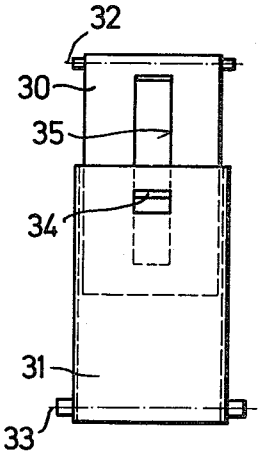
FIG. 7 is a plan view of the telescopic connecting device of the embodiment of FIG. 6 as taken in the arrow VII in FIG. 6.

In the embodiment of FIG. 4 the ankle support 12, which embraces the leg of a wearer just above the ankle, is connected to the heel grip 8 by means of an articulated linkage 20 which comprises two flat arms 21 and 22 pivoted together by a pivot 23. The upper arm 21 is pivotally connected to the ankle support 12 by a pivot 24, and the lower arm 22 is pivotally connected to the heel grip 8 by a pivot 25. This ensures the greatest possible freedom of movement for a wearer to move his foot in the plane including the foot and leg while nevertheless offering support against lateral and twisting movements. There are shown in broken outline in FIG. 4, various different positions which the linkage 20, and therefore the ankle support 12, can adopt in use upon pivoting of the linkage 20 about the pivots 23, 24 and 25. This ensures that the ankle support 12 can remain in the most comfortable position thereby avoiding uncomfortable pressure or rubbing or chafing of the leg at the edges of the cushion pad 14 of the support 12.

Figure 6:
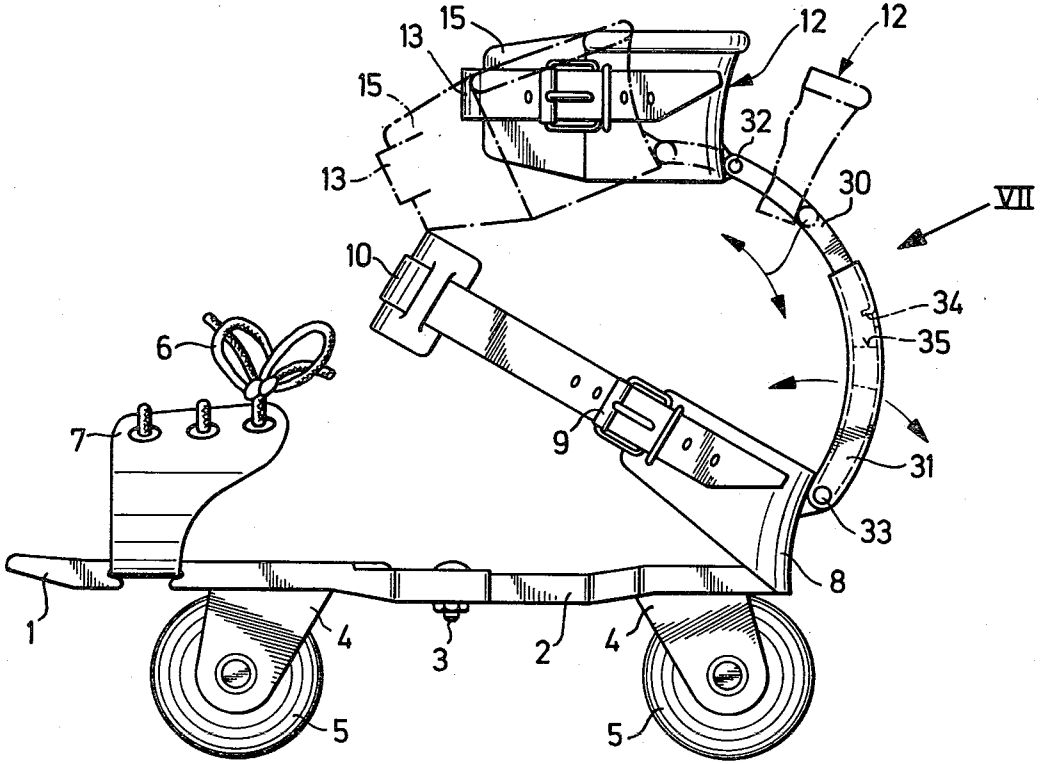
FIG. 6 is a side view of a roller skate formed as a fourth embodiment of the invention, with telescopic tubes connecting the ankle support to the heel grip.

The embodiment shown in FIG. 6 has two curved telescopic tubes 30 and 31 linking the ankle support 12 to the heel grip 8. These have a rectangular cross section to ensure a faultless guidance of the movement of the ankle support 12 in the plane including the ankle support and the two rollers of the roller skate. The lower tube 31 is pivotally connected to the heel grip 8 of the roller skate by means of a pivot 33, and the upper tube 30 is pivotally connected to the ankle support by a pivot 32. In order to ensure a perfect guidance of the telescopic tubes, the outer tube 31 is provided with an integrally projecting lug 34 which slides in a groove 35 of the inner tube 30.

I claim:

1. A single tracked roller skate, comprising:
a base,
a plurality of rollers, arranged along a single track,
means mounting said base on said plurality of rollers,
first and second fastening means on said base for fastening said skate to the foot of a wearer, said first fastening means being located adjacent the front of the base and said second fastening means being located adjacent the back of said base for fastening the ankle of a wearer, said second fastening means comprising:
heel grip means including a generally U-shaped, rigid yoke member which is rigidly secured to the rear of said base and projects obliquely upwardly and forwardly therefrom to surround the heel of the wearer,
an ankle strap on said heel grip means for encircling the foot of a wearer about the ankle,
ankle support means engageable with the leg of a wearer immediately above the ankle, said ankle support means including a cradle for supporting engagement with the leg of a wearer, said ankle support cradle being a concave C-shape in cross section and inwardly convex in longitudinal section, and
means pivotably mounting said ankle support means on said heel grip means at a point adjacent to the wearer's ankle, so as to permit pivotal displacement with respect to said base about an axis substantially parallel to the rolling axis of said rollers.

2. The roller skate of claim 1, wherein said ankle support cradle has,
a forwardly projecting padded tongue and
an associated fastening strap for encircling the leg of a wearer.

3. The roller skate of claim 1, wherein there is a two part connection device connecting said ankle support cradle to said heel grip means, said two part connection device extending behind the heel of a wearer.

4. The roller skate of claim 3, wherein said two part connection device comprises two pivoted links which are fixed together by a pivot, the upper end of one link being attached to said ankle support cradle by a pivot, and the lower end of the other link being attached to said heel grip means by a pivot.

5. The roller skate of claim 3, wherein said two part connection device comprises two telescopic tubes, one of said telescopic tubes being connected to said ankle support cradle and the other of said telescopic tubes being connected to said heel grip means.

6. The roller skate of claim 5, wherein said two telescopic tubes are substantially rectangular in cross section.

7. The roller skate of claim 5, wherein said two telescopic tubes are curved.

8. The roller skate of claim 5, wherein the ends of said two telescopic tubes are pivotally connected to said ankle support cradle and said heel grip means respectively.

9. The roller skate of claim 1 wherein said ankle support cradle has integrally formed arms by which said cradle is directly pivoted onto said heel grip means.

10. The roller skate of claim 1, wherein said plurality of rollers each have rolling surfaces which are convexly curved in axial section.

11. The roller skate of claim 10, wherein said plurality of rollers each have a plurality of circumferentially extending grooves in the rolling surfaces thereof.

12. The roller skate of claim 1, wherein said rollers are made of a resilient elastomeric material.

13. The roller skate of claim 12, wherein said plurality of rollers each have a plurality of circumferentially extending grooves in the rolling surfaces thereof.

* * * * *